US009551167B2

(12) United States Patent
Pickard

(10) Patent No.: US 9,551,167 B2
(45) Date of Patent: Jan. 24, 2017

(54) PADLOCK RETAINING DEVICE

(71) Applicant: Mark A. Pickard, Riverside, CA (US)

(72) Inventor: Mark A. Pickard, Riverside, CA (US)

( * ) Notice: Subject to any disclaimer, the term of this patent is extended or adjusted under 35 U.S.C. 154(b) by 0 days.

(21) Appl. No.: 14/683,317

(22) Filed: Apr. 10, 2015

(65) Prior Publication Data

US 2016/0083977 A1 Mar. 24, 2016

Related U.S. Application Data

(60) Provisional application No. 62/052,134, filed on Sep. 18, 2014.

(51) Int. Cl.
*E05B 17/00* (2006.01)
*E05B 65/00* (2006.01)
*E05B 67/38* (2006.01)

(52) U.S. Cl.
CPC ..... *E05B 65/0021* (2013.01); *E05B 2067/386* (2013.01); *Y10T 70/30* (2015.04); *Y10T 70/5319* (2015.04)

(58) Field of Classification Search
CPC ..... E05B 17/00; E05B 67/38; E05B 67/383; E05B 2067/386; Y10T 70/30; Y10T 70/5319
USPC ..... 70/2, 54–56, 129, DIG. 43, DIG. 56; 292/148, 205, 281, DIG. 13, DIG. 36; 160/201
See application file for complete search history.

(56) References Cited

U.S. PATENT DOCUMENTS 1,330,936 A * 2/1920 Erickson ..... A47B 88/0029 220/4.01
1,368,711 A * 2/1921 Foley ..... E05C 1/04 292/148
2,482,341 A * 9/1949 Holmsten ..... E05C 1/04 292/148
2,845,295 A * 7/1958 Clarke ..... E05C 19/08 292/1
3,599,453 A * 8/1971 Bauernfeind ..... E05C 1/04 292/148
3,736,016 A * 5/1973 Garvey ..... E05B 67/38 292/281
3,744,280 A * 7/1973 Brown, Jr. ..... E05B 67/38 292/231
3,907,344 A * 9/1975 Newlon ..... E05C 3/167 292/244
4,095,828 A * 6/1978 East ..... E05B 67/383 292/148
4,214,783 A * 7/1980 Boegeman ..... E05C 1/04 292/148
4,300,370 A * 11/1981 Kaiser ..... E05B 67/38 70/54
4,331,356 A * 5/1982 Noel ..... E05C 19/08 292/281
4,345,448 A * 8/1982 Solomon ..... E05B 65/0864 292/346

(Continued)

OTHER PUBLICATIONS

Global Industrial.com website page. Publication date unknown. 1 page.

*Primary Examiner* — Lloyd Gall
(74) *Attorney, Agent, or Firm* — Jeffrey G. Sheldon; Leech Tishman; Fuscaldo & Lampl

(57) ABSTRACT

A padlock retaining device has: a) a stand-alone body, separate from any locking device or latching device, the body having one or more body attachment facilitators and b) a lock containment section attached to and extending away from the body for accepting and retaining an open padlock.

18 Claims, 4 Drawing Sheets

(56) References Cited

U.S. PATENT DOCUMENTS 4,482,177 A * 11/1984 Nagy ..... E05C 17/00 292/150
4,666,220 A * 5/1987 Bucaille ..... B63B 35/7946 211/70.5
4,761,975 A * 8/1988 Kachnowski ..... E05B 67/383 70/232
4,801,121 A * 1/1989 Zunker ..... E05B 67/383 248/218.4
5,179,848 A * 1/1993 Kief ..... B62J 11/00 224/413
5,287,710 A * 2/1994 James ..... E05B 17/20 292/148
5,469,722 A * 11/1995 Ellefsen ..... E05B 67/36 70/2
5,624,071 A * 4/1997 Sosan ..... A47G 29/20 232/1 B
5,704,232 A * 1/1998 Kuo ..... B62J 11/00 248/229.1
5,934,111 A * 8/1999 Hernandez ..... E05C 19/08 292/205
6,477,872 B1 * 11/2002 Denton, Jr. ..... E05B 67/36 70/100
6,581,419 B1 * 6/2003 Strodtman ..... E05B 13/002 292/205
7,236,085 B1 * 6/2007 Aronson ..... E05B 45/005 109/45
7,562,546 B2 * 7/2009 Taylor ..... E05B 67/36 248/551
2009/0260407 A1 * 10/2009 Henson ..... E05B 67/38 70/129
2011/0031013 A1 * 2/2011 Combs ..... E05B 67/383 174/559
2011/0198866 A1 * 8/2011 Benson ..... E05B 67/383 292/150
2014/0091694 A1 * 4/2014 Trinh ..... E05B 65/44 312/333
2015/0061300 A1 * 3/2015 Hudson ..... E05D 15/16 292/164

* cited by examiner

PADLOCK RETAINING DEVICE

RELATED APPLICATIONS

This application claims priority from U.S. Patent Application Ser. No. 62/052,134 entitled "Padlock Retaining Device," filed Sep. 18, 2014, the entirety of which is incorporated herein by reference.

BACKGROUND

Roll-up doors are used for a wide variety of applications. For example, roll-up doors are frequently used to secure the interiors of enclosed storage areas, such as the areas within storage units in a commercial self-storage rental facility.

When used to secure the interior of enclosed storage areas, the roll-up doors are typically made from steel and the doors are provided with a locking apparatus. In the most common applications, such locking apparatuses comprise at least one slidable bolt attached to the door or a strong slide rail. FIG. 1 illustrates such a locking apparatus. The slidable bolt can be alternatively (1) slid in one direction along the slide rail to a "latched position," wherein the bolt is caused to protrude into a strike plate mounted on the door frame (to prevent the door from traveling upward) and (2) slid in the opposite direction along the slide rail to an "unlatched position," wherein the bolt is retracted out of the strike plate (to allow the door to again freely travel upward).

Typically, the slide rail and the slidable bolt each have a padlock retainer portion defining a locking through-hole which is sized and dimensioned to accept a padlock shackle (curved portion). The holes in the padlock retainer portions are located so that, when the bolt is slid to the latched position, the holes are aligned with one another such that a padlock shackle can be placed and secured within both holes to lock the bolt within the latched position (as illustrated in FIG. 2).

It is also common that both the slide rail and the bolt have an auxiliary hole—termed a manager's overlock hole—which can be used by the manager of a facility employing the roll-up door to lock the door in the latched position (for example, if rent is overdue). The manager's overlock hole can also be used to retain the padlock on the roll-up door when the bolt is in the unlatched position. This design seems to provide the user with a convenient place to store the padlock when it is not being used, such as immediately after the user unlocks the padlock and slides the bolt to the unlatched position in preparation for opening the roll-up door. The problem with this design, however, is that, if the user forgets to remove the padlock from the manager's overlock hole before the roll-up door is opened, the padlock will be carried upwards as the roll-up door is opened and strike the upper horizontal portion of the door frame. This illustrated in FIG. 3. Because roll-up doors are typically heavy and carry considerable momentum, such striking of the door frame can cause significant damage to the door frame, to the latch assembly and/or to the roll-up door. If the door frame is made of steel or other heavy material, the striking of the door frame with the padlock can rip the latch assembly off of the roll-up door.

Accordingly, there is a need for a padlock retaining device that addresses the problem often encountered with the use of roll-up doors.

SUMMARY OF THE INVENTION

The invention satisfies this need. The invention is a unique padlock retaining device. The padlock retaining device comprises: a) a stand-alone body, separate from any locking device or latching device, the body having one or more body attachment facilitators and b) a lock containment section attached to and extending away from the body for accepting and retaining an open padlock.

The invention is also a method of employing the padlock retaining device to prevent damage caused by inadvertently opening a roll-up door with a padlock still attached to the roll-up door.

DRAWINGS

These and other features, aspects and advantages of the present invention will become better understood with reference to the following description, appended claims, and accompanying drawings where:

DETAILED DESCRIPTION OF THE INVENTION

Figure 1:
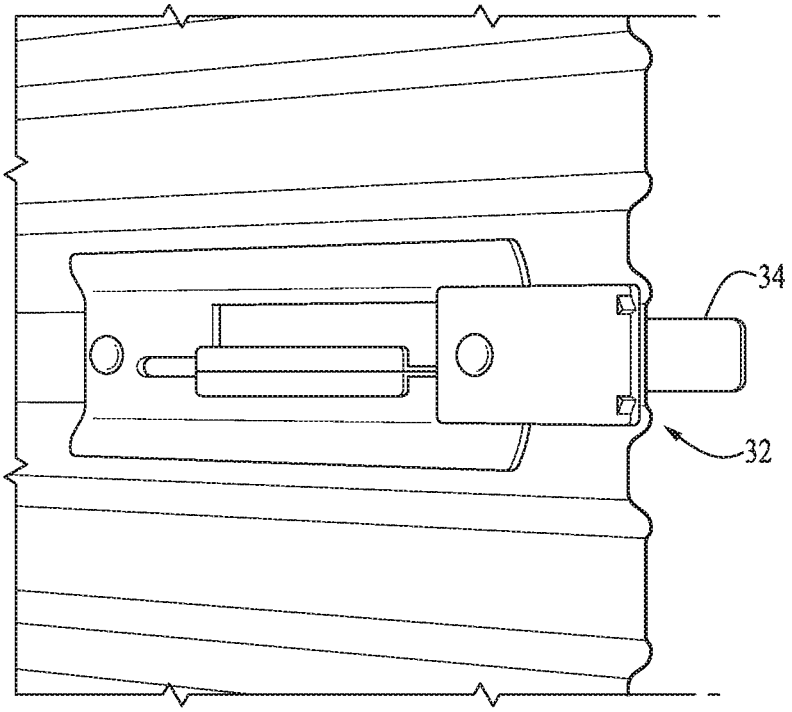
FIG. 1 PRIOR ART
FIG. 1 is a sketch illustrating a slide lock of the prior art.
Figure 3:
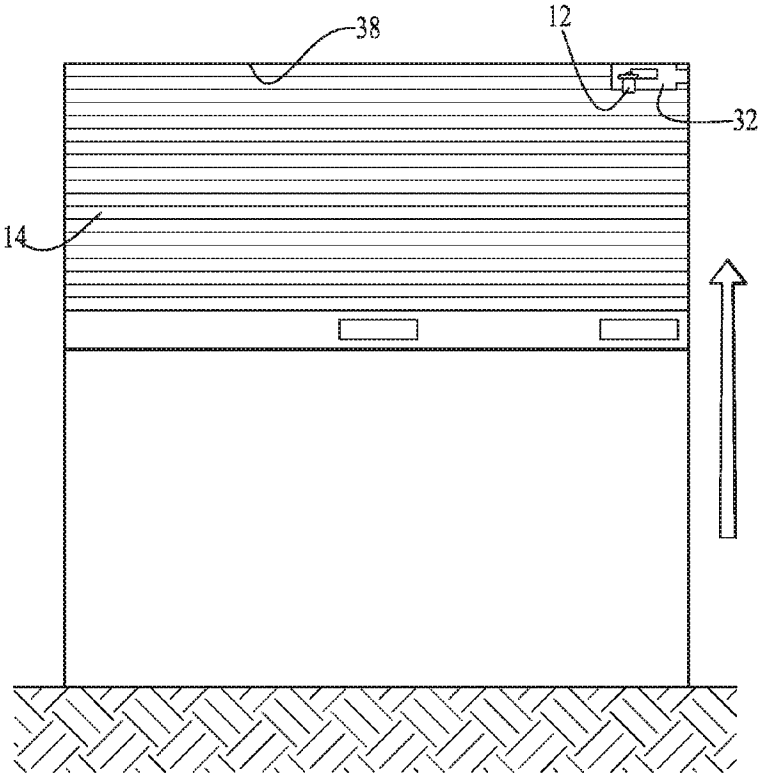
FIG. 3 PRIOR ART
FIG. 3 is a sketch illustrating the roll up door of FIG. 2 wherein the padlock has been opened and hung loosely on the slide lock and wherein the roll up door has been rolled up to inadvertently cause the padlock to strike the top of the door frame.
Figure 2:
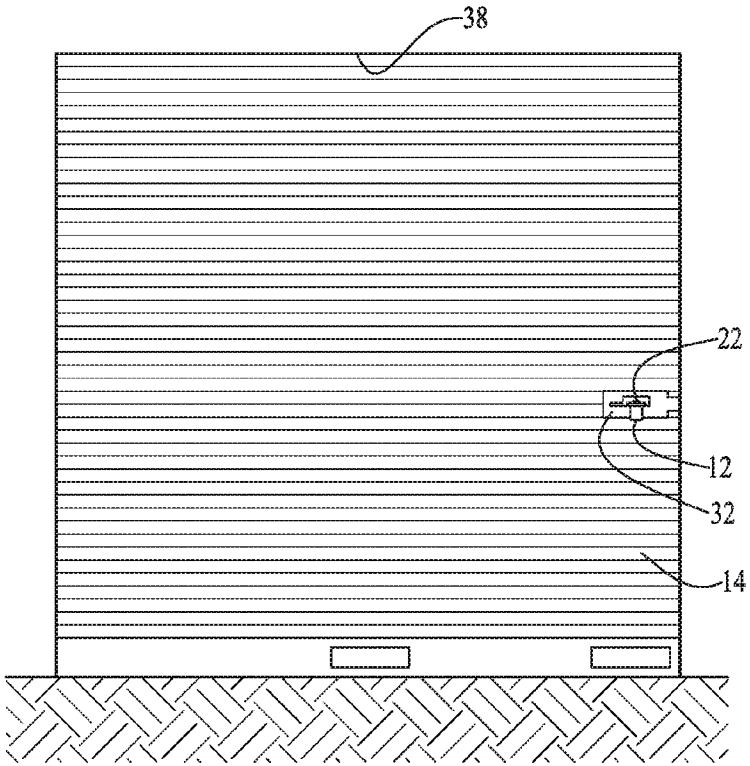
FIG. 2 PRIOR ART
FIG. 2 is a sketch illustrating a slide lock attached to a roll up door disposed within a door frame, wherein a padlock has been operably placed on the slide lock to secure the slide lock in a latched position.
Figure 4:
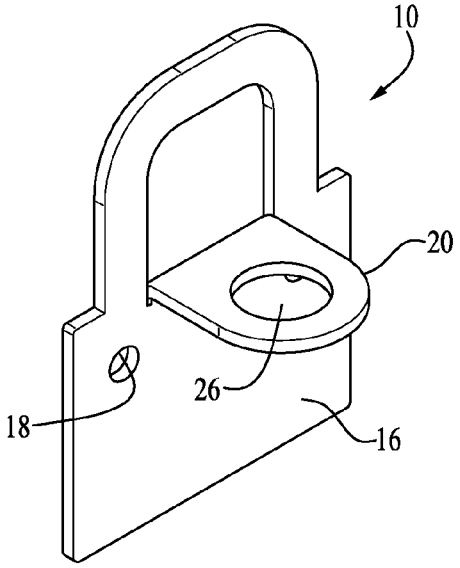
FIG. 4 is a perspective view of a padlock retaining device having features of the invention.
Figure 5:
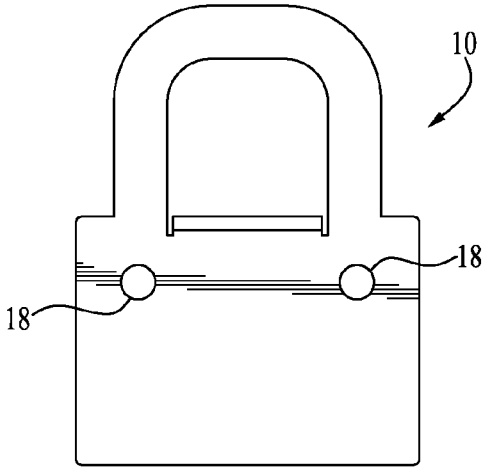
FIG. 5 is a front view of the padlock retaining device illustrated in FIG. 4.
Figure 6:
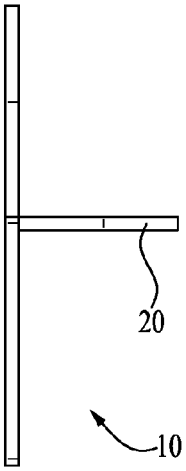
FIG. 6 is a side view of the padlock retaining device illustrated in FIG. 4.
Figure 7:
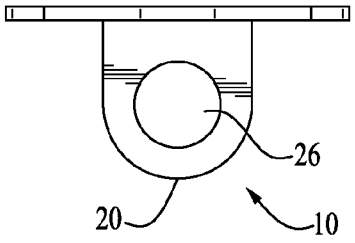
FIG. 7 is a top view of the padlock retaining device illustrated in FIG. 4.

The following discussion describes in detail one embodiment of the invention and several variations of that embodiment. This discussion should not be construed, however, as limiting the invention to those particular embodiments. Practitioners skilled in the art will recognize numerous other embodiments as well.

DEFINITIONS

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers, ingredients or steps.

The Invention

In one aspect, the invention is a padlock retaining device 10 built specifically to hold a padlock 12 in a convenient location adjacent to a roll-up door 14, not on the roll-up door 14 itself. FIGS. 4-7 illustrate one embodiment of the invention.

The padlock retaining device 10 comprises a body 16, one or more body attachment facilitators 18, and a lock containment section 20. The padlock retaining device 10 can be any size and dimension, and made from any material, including plastic, wood or metal. In the embodiment illustrated in FIGS. 4-7, the padlock retaining device 10 can be 2 and ¾ inches tall, 1 and ⅞ inches wide and preferably can be made from a single plate of steel.

The body 16 can be any shape and dimension, but preferably the body 16 is planar. In the embodiment illustrated in FIGS. 4-7, the body 16 is in the shape of a padlock. In the embodiment illustrated in FIGS. 4-7, the padlock retaining device 10 has two body attachment facilitators 18 which be used to attach the padlock retaining device 10 to a wall surface 36 adjacent a roll-up door 14. Optionally, the two body attachment facilitators 18 can be fastener holes, and the padlock retaining device 10 can be attached to the wall surface 36 using any type of fastener, for example, stainless steel fasteners, screws or rivets depending on the application.

The lock containment section 20 is configured to accept and retain a padlock shackle 22. The lock containment section 20 is coupled to the body 16 at a sufficient angle to accept and retain a padlock shackle 22. The lock containment section 20 can be made from any material, including plastic, wood or metal, but preferably it is made from steel. The lock containment section 20 can be any size and dimension, but preferably it is about ⅞ inches long.

Optionally, the padlock retaining device 10 can be made from a single plate of steel, as shown in the embodiment illustrated in FIGS. 4-7. Because the padlock retaining device 10 can be made from a single plate of steel, the lock containment section 20 is a portion of the padlock retaining device 10 that is bent away from the body 16. Preferably the lock containment section 20 is bent away from the body 16 at a 90 degree angle with respect to the body 16.

The lock containment section 20 can also have a padlock shackle retaining hole 26 defined therein. The padlock shackle retaining hole 26 is sized and dimensioned to accept and retain a padlock shackle 22. The padlock shackle 22 is inserted through the padlock shackle retaining hole 26 such that the padlock 12 is now retained by the padlock retaining device 10.

In another aspect, the invention is a method of employing the padlock retaining device 10 to prevent damage caused by inadvertently opening a roll-up door 14 with a padlock 12 still attached to the roll-up door 14.

The padlock retaining device 10 is especially useful for a roll-up door 14 comprising a locking apparatus 32 having:

a slidable bolt 34 attached to the door on a slide rail, wherein the bolt 34 can be alternatively (1) slid in one direction along the slide rail to a "latched position," wherein the bolt 34 is caused to protrude into a strike plate mounted on the door frame (to prevent the roll-up door 14 from travelling upward) and (2) slid in the opposite direction along the slide rail to an "unlatched position," wherein the bolt 34 is retracted out of the strike plate (to allow the roll-up door 14 to again freely travel upward);

padlock retainer portions defined within both the slide rail and the bolt 34 to provide a locking through-hole which is sized and dimensioned to accept a padlock shackle 22, the holes in the padlock retainer portions being located so that, when the bolt 34 is slid to the latched position, the holes are aligned with one another such that a padlock shackle 22 can be placed and secured within both holes to lock the bolt 34 within the latched position; and a manager's overlock hole defined in both the slide rail and the bolt 34 which is operatively configured to retain the padlock 12 on the roll-up door when the bolt 34 is in the unlatched position.

As discussed above, many users secure the padlock 12 to the manager's overlock hole (not shown) after they have removed the padlock 12 from the roll-up door 14, but prior to actually opening the roll-up door 14. Then the roll-up door 14 is moved upward to an open position, which causes the locking apparatus 32 to strike the upper portion of the door frame 38.

Figure 8:
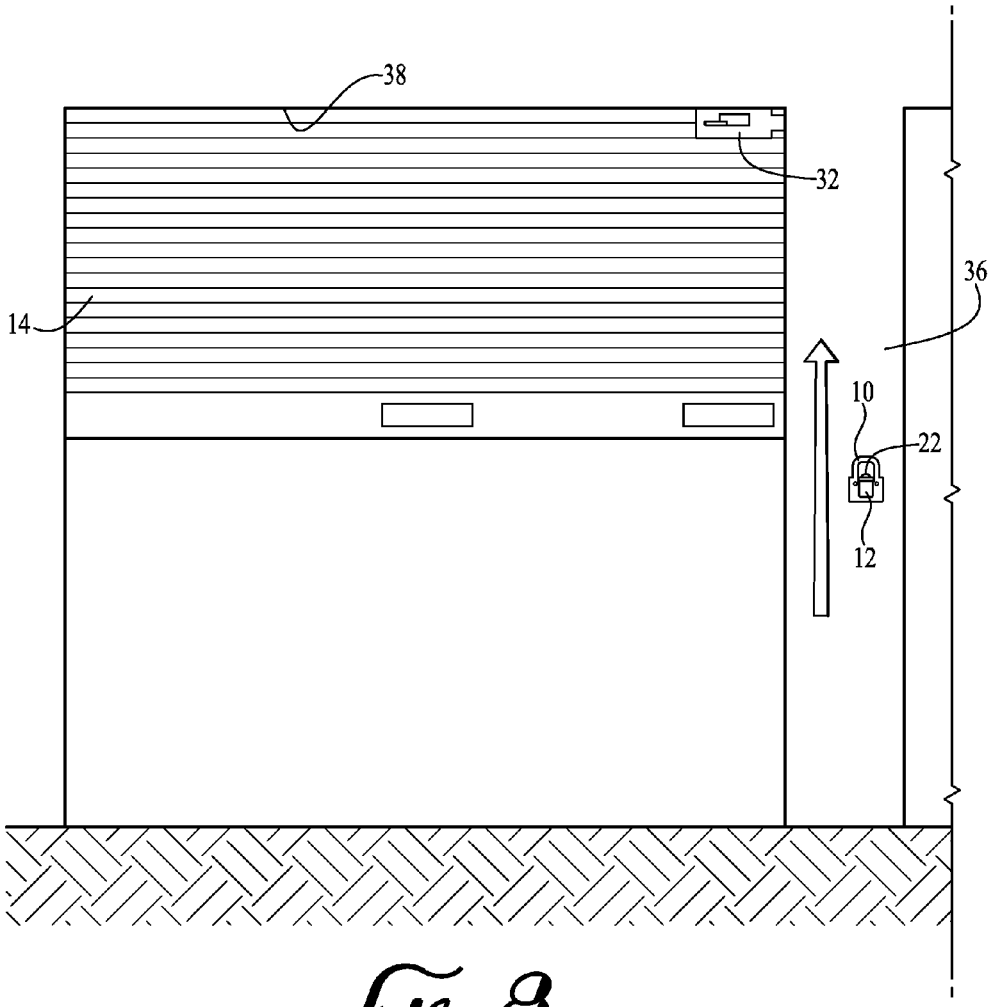
FIG. 8 is a sketch illustrating a slide lock attached to a roll up door disposed within a door frame, and a padlock opened and hung loosely on a padlock retaining device having features of the invention.

In the method, the padlock retaining device 10 is attached to a wall surface 36—typically a vertical wall surface—separate from the roll-up door 14 for which a padlock 12 is used to secure the roll-up door 14 in the latched position. Then the padlock 12 is retained on the padlock retaining device 10 when the padlock 12 is not in use by disposing the padlock shackle 22 into the padlock shackle retaining hole 26—as illustrated in FIG. 8.

The method of employing the padlock retaining device 10 comprises the steps of providing the padlock retaining device 10, attaching the padlock retaining device 10 to a wall surface 36 separate from the roll-up door 14 by the one or more body attachment facilitators 18, disposing the padlock shackle 22 into the lock containment section 20, and retaining the padlock 12 on the padlock retaining device 10 when the padlock 12 is not in use.

The method effectively prevents damage to the roll-up door 14, the locking apparatus 32 and/or the door frame 38 by inadvertently rolling the roll-up door 14 upwards while the padlock 12 is attached in the auxiliary manager's overlock hole of the locking apparatus 32—thereby causing the locking apparatus 32 to strike the upper portion of the door frame 38.

What is claimed is:

1. A door locking and unlocking system comprising:

a) a roll-up door that can move to an open position from a closed position, the door being proximate to a structure separate from the door;

b) a locking mechanism including a bolt slidable relative to the door and structure for locking the door in the closed position, the locking mechanism being lockable with a padlock having a shackle, a first part of the locking mechanism being attached to the door and a second part of the locking mechanism being attached to the structure proximate the door; and c) a padlock retaining device not part of the locking mechanism, the padlock retaining device comprising a body section secured to the structure and not secured to the door, the padlock retaining device comprising a lock containment section attached to and extending away from the body section, the lock containment section having a padlock shackle retaining hole for receiving the padlock shackle.

2. The system according to claim 1, wherein the body section of the padlock retaining device is planar.

3. The system according to claim 1, wherein the body section of the padlock retaining device comprises at least one fastener hole.

4. The system according to claim 1, wherein the lock containment section extends away from the body section at a 90 degree angle with respect to the body section.

5. The system according to claim 1, wherein the padlock retaining device is made from a single plate of steel.

6. The system according to claim 1, wherein the body section of the padlock retaining device is 2 and ⅜ inches tall.

7. The system according to claim 1, wherein the body section of the padlock retaining device is 1 and ⅞ inches wide.

8. The system of claim 1, further comprising a padlock for locking the locking mechanism with the door in the closed position.

9. The system of claim 1, wherein the body section of the padlock retaining device is in the shape of a body portion and shackle of a padlock.

10. A method for unlocking a roll-up door, the door being moveable relative to a structure proximate to the door from a closed position to an open position, the door having a locking mechanism including a bolt slidable relative to the door and structure and comprising a first part attached to the door and a second part attached to the structure proximate the door, a padlock locking the locking mechanism with the door in a closed position, the padlock having a shackle, and a padlock retaining device not part of the locking mechanism, the padlock retaining device comprising a body section not secured to the door and secured to the structure proximate to the door, the padlock retaining device comprising a lock containment section attached to and extending away from the body section, the lock containment section having a padlock shackle retaining hole for receiving the padlock shackle with the padlock in an open position, the method comprising the steps of:

a) unlocking the padlock to unlock the locking mechanism;

b) after step (a), removing the padlock from the locking mechanism; and c) after step (b), placing the shackle of the padlock in the retaining hole of the padlock retaining device so that the padlock does not interfere with opening of the door.

11. The method of claim 10, comprising the additional step of opening the door.

12. The method of claim 10, wherein the body section of the padlock retaining device is planar.

13. The method of claim 10, wherein the body section of the padlock retaining device comprises at least one fastener hole.

14. The method of claim 10, wherein the lock containment section extends away from the body section at a 90 degree angle with respect to the body section.

15. The method of claim 10, wherein the padlock retaining device is made from a single plate of steel.

16. The method of claim 10, wherein the body section of the padlock retaining device is 2 and ¾ inches tall.

17. The method of claim 10, wherein the body section of the padlock retaining device is 1 and ⅞ inches wide.

18. The method of claim 10, wherein the body section of the padlock retaining device is in the shape of a body portion and shackle of a padlock.

* * * * *